United States Patent [19]

Savignac

[11] Patent Number: 4,549,522

[45] Date of Patent: Oct. 29, 1985

[54] HEAT EXCHANGER FOR STOVES AND FIRE-PLACES

[76] Inventor: Germain Savignac, 26 Archambault St., St. Jean de Matha, Canada, J0K 2S0

[21] Appl. No.: 656,991

[22] Filed: Oct. 2, 1984

[51] Int. Cl.[4] ..... F24B 7/00

[52] U.S. Cl. ..... 126/72; 126/123; 237/51

[58] Field of Search ..... 126/126, 77, 131, 121, 126/123, 61, 72, 70, 71, 67; 237/51, 52

[56] References Cited

U.S. PATENT DOCUMENTS

| | | | |
|---|---|---|---|
| 1,773,858 | 8/1930 | Radford | 126/121 |
| 4,095,581 | 6/1978 | Billmeyer et al. . | |
| 4,129,113 | 12/1978 | Bergstrom | 126/121 |
| 4,151,827 | 5/1979 | Rae . | |
| 4,166,444 | 9/1979 | Martenson | 126/121 |
| 4,206,742 | 6/1980 | Johnson | 126/67 X |
| 4,319,558 | 3/1982 | Thurlo | 126/121 |
| 4,381,760 | 5/1983 | Reges | 126/138 |
| 4,397,292 | 8/1983 | Mitchell | 126/67 X |

FOREIGN PATENT DOCUMENTS

| | | |
|---|---|---|
| 266201 | 11/1926 | Canada . |
| 277807 | 2/1928 | Canada . |
| 760240 | 6/1967 | Canada . |

*Primary Examiner*—Larry Jones

[57] ABSTRACT

A network of air-heating ducts is inserted between the fire bricks of a stove or fire-place to increase the thermal efficiency of the heating apparatus. Cool air from the room is supplied by an electric fan and a manifold to a first series of U-shaped ducts extending between the fire bricks of the floor and rear wall of the heating apparatus and extending forwardly along the top wall to open within the room at the front of the heating apparatus. When fuel is burning inside the fire-box, hot air exits directly into the room. Another series of air ducts extends from the same manifold between the bricks of the side walls of the heating apparatus and connects with an L-shaped chamber mounted adjacent the rear wall of the apparatus. This chamber feeds hot air to other rooms of the house by an additional electric fan connected across the legs of the L-shaped chamber.

1 Claim, 7 Drawing Figures

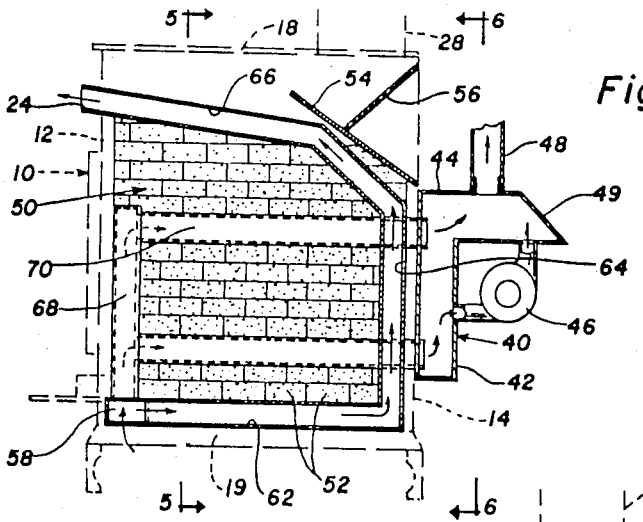
Fig. 4
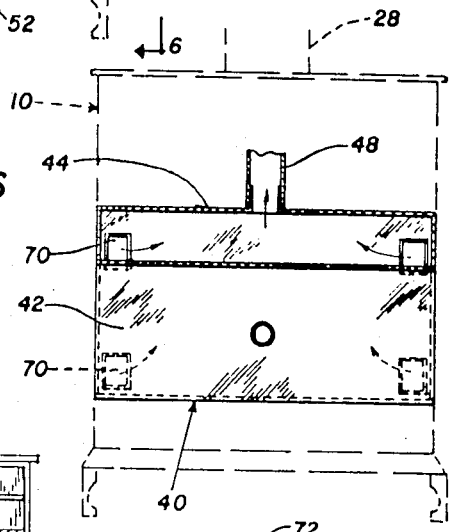
Fig. 6
Fig. 5
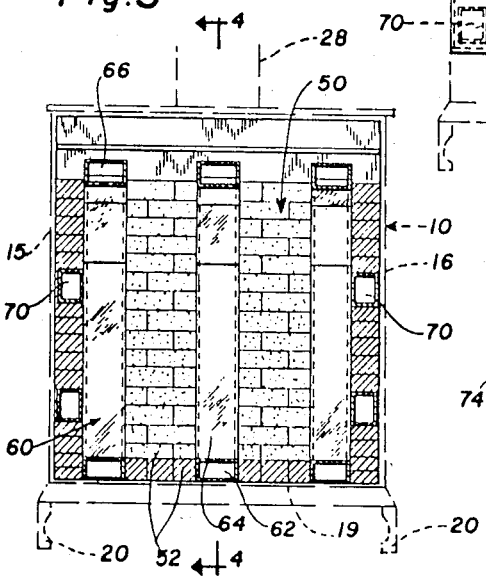
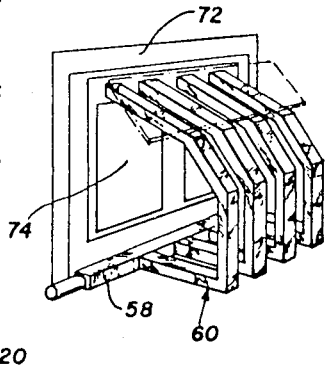
Fig. 7

HEAT EXCHANGER FOR STOVES AND FIRE-PLACES

FIELD OF THE INVENTION

This invention relates to domestic heating and, more specifically, to improvements in the thermal efficiency of stoves and open fire-places.

BACKGROUND OF THE INVENTION

The use of wood stoves or open fire-places and the like heating apparatuses is on the increase, because of the considerable increase in recent times of heating fuel prices. Previous patents have presented inventions with means for extraction of a major portion of the heat from the fire and projecting it into the room, to increase the thermal efficiency of the system; for example, Billmeyer's U.S. Pat. No. 4,095,581, issued June 20, 1978; Meyes' Canadian Pat. No. 1,090,225, issued Nov. 25, 1980; Hannum's Canadian Pat. No. 328,702, issued Feb. 14, 1928; and Bennett's Canadian Pat. No. 296,067, issued Nov. 30, 1926. In another patent, Collard's Canadian Pat. No. 760,240, issued June 6, 1967, an air generator is added to convey the air at a given speed within a tire grate. Further, in Rae's U.S. Pat. No. 4,151,827, issued May 1, 1979, an electric-driven blower circulates the air from the room through a heat exchanger forming the rear wall component of the fire-place.

All these inventions embody improvements in the thermal efficiency of the stove or fire-place. However, the circulated air is heated only when a fire is active within the stove or fire-place. It may be appropriate to find a way to lengthen the heating period of the circulating air before having to feed more fuel into the fire.

OBJECTS OF THE INVENTION

It is accordingly a prime object of the invention to increase the thermal efficiency of stoves and the like heating apparatus by increasing the length of the heating period.

A further object of the invention is to provide a network of hot air ducts inserted between the fire bricks of the fire-box, whereby the heat stored in the bricks is still transmitted to the air ducts long after the fire is out.

An additional object of the invention is to provide a heat exchanger which operates to deliver hot air not only within the room adjacent to the fire-place or stove, but also to other rooms of the house.

SUMMARY OF THE INVENTION

A network of air ducts is inserted between the fire bricks of the floor and walls of a heating apparatus, such as a stove or open fire-place. This network comprises a first manifold laid transversely of the heating apparatus across the front of the floor; a first series of vertically-disposed U-shape ducts connected to said manifold at their inlet ends and extending rearwardly within the floor upwardly within the rear wall and forwardly under the top wall of the heating apparatus to exit directly into the room where the heating apparatus is located. Preferably, a second set of air ducts extend between the fire bricks of the side walls of the apparatus and have their front ends connected to the above-mentioned manifold by upright manifold ducts located at the front of said side walls. This second set of air ducts exit at the back of the apparatus and are preferably connected to a collection chamber provided with a distribution duct to circulate hot air to other rooms of the house. Preferably cold air is supplied to the first manifold by means of a first electric fan and a second electric fan mounted in parallel series with the chamber serves to accelerate the air flow through the distribution duct. Since the ducts of the heat exchanger are inserted between and in contact with the fire bricks of the fire-box, the heat stored within said fire bricks will continue to heat the air circulating in the ducts a long time after the fire is out.

BRIEF DESCRIPTION OF THE DRAWINGS

FIG. 4 is a front to rear sectional view of the fire-box of FIG. 3, taken along line 4—4 of FIG. 5;

FIG. 5 is a transverse sectional view of the fire-box, takken along line 5—5 of FIG. 4;

FIG. 6 is a sectional view taken along line 6—6 of FIG. 4 and

FIG. 7 is a perspective view of the heat-exchanger arrangement and including the door frame to surround the front opening of a fire-place.

DETAILED DESCRIPTION OF THE DRAWINGS

Figure 1:
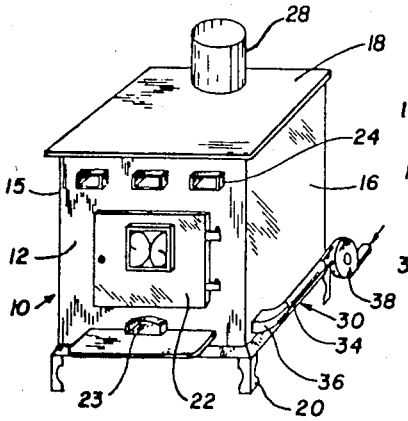
FIG. 1 is a front perspective view of a stove equipped with a heat exchanger in accordance with the invention.
Figure 2:
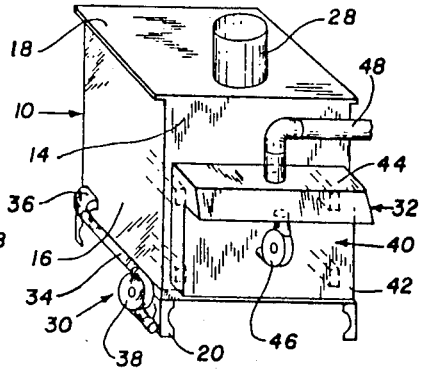
FIG. 2 is a rear perspective view of the same.

Referring to FIGS. 1 and 2, a stove for burning wood or other solid fuel is shown at 10 to be installed in a room of a house or building. The stove 10 is made of a metal casing, which includes a front wall 12, a rear wall 14, side walls 15 and 16, a top wall 18 and a floor 19. The stove 10 is preferably supported by legs 20. The front wall 12 has the usual access doors 22 and 23 and also several hot air outlets 24 disposed above access door 22. The top wall 18 has an aperture engaged by an exhaust pipe 28 for the escape of the combustion gases coming from the burning fuel.

According to the novel features of the invention, a first and a second fan and duct arrangements 30 and 32 are provided on the stove 10. More specifically, the first arrangement 30 includes an air inlet duct 34 extending along the exterior sidewall 16 and connected to elbow 36 at the front of the stove and connected to the outlet of an air supply electric fan 38 at the back of the stove. Cool air from the house may be admitted to fan 38 or, alternately, outside air.

The second arrangement 32 consists of a hot air chamber 40, of L-shape cross-section, having one rectangular leg 42 carried by the stove adjacent the rear wall 14 and a rearwardly-oriented upper leg 44, having a bevelled outer end 49. An air circulating electric fan 46 is connected in parallel with the two legs of the chamber circulating hot air from leg 42 to leg 44, opposite the bevelled end 49.

Figure 3:
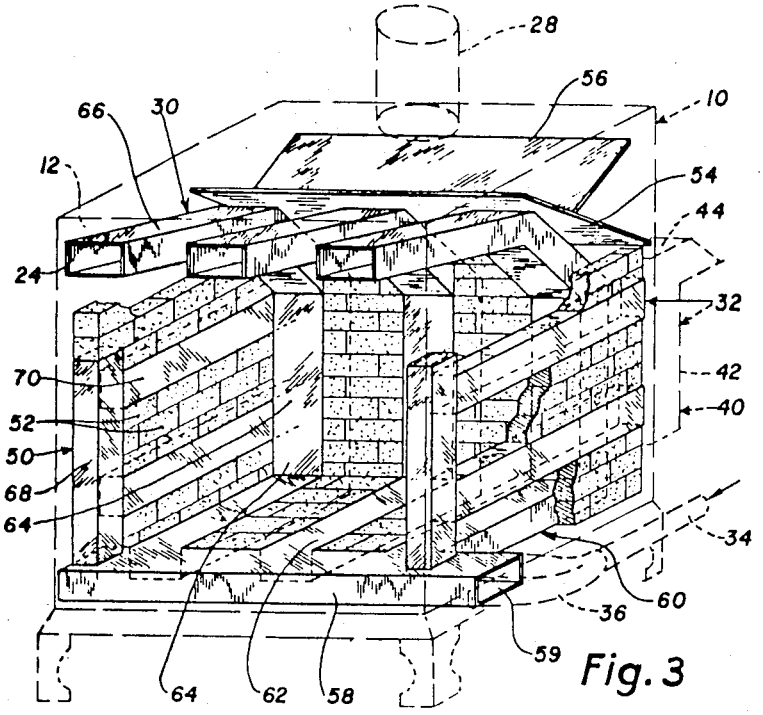
FIG. 3 is a perspective view of the fire-box and the heat-exchanger duct network and showing the stove casing in dotted lines.

Referring to FIG. 3, the stove fire-box 50 includes fire bricks 52 lining the inside of the stove casing walls 14, 15, 16, and 19, that is the floor, the rear wall and the side walls of the fire-box. A combustion gas-deflecting steel plate 54 is fixed to the casing of the stove and extends between the side walls 15 and 16 from the back wall 14, being upwardly and forwardly inclined towards the front of the stove casing. This deflecting plate 54 extends just above the fire bricks of the side walls and rear walls of the fire-box and terminates just forwardly of exhaust pipe 28, as shown in FIG. 4.

An additional plate 56 is secured to the deflecting plate 54 about midway of the width of the same and extends upwardly and rearwardly to the top rear corner of the stove casing, in order to lead the combustion gases into the exhaust pipe 28. The heat exchanger in accordance with the present invention comprises a manifold duct 58, of generally rectangular cross-section, and extending transversely of the front of the floor of the stove. The inlet end 59 of said manifold 58 is connected to the elbow 36.

A series air ducts 60 each of generally U-shape configuration, are positioned in spaced vertical and parallel planes within the fire-box and extend between the fire bricks 52 lining the floor 19 and the rear wall 14, as indicated by the horizontal legs 62 and vertical legs 64 of the ducts 60. The horizontal legs 62 are connected at their front end to the manifold 58. The vertical legs 64 are extended by top legs 66, which are free of the fire bricks 52 and extend forwardly of the stove spaced beneath top wall 18 and extending through the front wall 12 to form the hot air outlets 24. These top legs 66 have a rear portion which is slightly spaced from the deflecting plate 54. The top face of the manifold 58 and of the horizontal lgs 62 and of the vertical legs 64 are exposed within the fire-box and substantially flush with the exposed faces of the fire bricks 52. The manifold 58 may define the front edge portion of the brick lining the floor of the stove, as shown, or another row of bricks may contact the front face of the manifold.

From the foregoing, it is clear that heat from the fire-box can be transmitted directly into the air circulating through the ducts 60 through their exposed walls, and that heat stored within the fire bricks can be transmitted to the air in the ducts through the side walls of the ducts in heat-exchanging contact with the fire bricks. Since it is known that fire bricks store a considerable amount of heat, it is obvious that this heat can continue to heat the air circulating through the duct even after the fire is out.

The hot combustion gases will flow around the exposed top legs 66 of the ducts 60 to further heat the air before it issues into the room through outlets 24.

A second network of heat-exchanger ducts is arranged in parallel with the just-described U-shape ducts 60. This second network includes upright tubular manifolds 68 arranged at the front portion of each side wall 15,16 and in communication at their lower end with the manifold 58.

A series of horizontally-disposed ducts 70 extend between the fire bricks 52 lining the side walls 15 and 16 of the stove. These ducts 70 are in communication at their front ends with a respective upright manifold 68, while the rear ends extend through the rear walls 14 and are connected to the vertical legs 42 of the chamber 40 at the back of the stove.

As for the first network of ducts 60, the manifolds 68 and ducts 70 are of generally rectangular cross-section, with an inner face exposed within the fire-box and with side faces in direct contact with the fire bricks, the ducts 70 being inserted between fire bricks 52. Cool air supplied by electric fan 38 fed through duct 34 and elbow 36 also enters the upright manifold 68 from the main manifold 58, where it is heated by circulating through horizontal lateral ducts 70. This hot air enters chamber 40 and is distributed to other rooms through distributing duct 48 with the assistance of the additional electric fan 46.

It will be noted that the additional fan 46 is connected in parallel with the two legs 42, 44 of the chamber 40, so as to accelerate only a portion of the hot air flowing through the chamber 40, thereby creating a venturi effect in horizontal leg 44 and in distribution duct 48.

FIG. 7 shows that the system of the invention can be adapted for installation in open fire-places. In this case, the second network of heat-exchanging ducts 68 and 70 is not necessary. FIG. 7 shows as a unit the manifold 58 and the U-shape ducts 60, all attached to a front frame 72 adapted to be applied onto the front wall of the fire-place and across its access opening and fitted, if desired, with hinge doors 74 in conventional manner.

As in the first embodiment, the manifold 58 and U-shape ducts 60 are adapted to be inserted between the fire bricks lining the floor and rear wall of the fire-box of the fire-place.

I claim:

1. In a stove, fire-place and the like heating apparatus, a combined fire-box and air-heat exchanger comprising a fire-box having a front wall, side walls, a floor and a top wall, said side walls, rear wall and floor being lined with fire bricks, said heat exchanger including a first network of air-circulating ducts inserted between the fire bricks lining said floor and said rear wall and having a face exposed within said fire-box, and a second network of air-circulating ducts inserted between the fire bricks lining said side walls and also having a face exposed within said fire-box, each duct of said first network being formed of legs at an angle to each other and forming a U-shape configuration; further including a manifold duct disposed transversely and in the front portion of the bricks lining the floor of said heating apparatus, said manifold in communication with said respective ducts at the forward end of the legs of said U-shape ducts, said U-shape ducts each defining a top leg extending from the rear wall to the front wall of said heating apparatus and spaced below the top wall of said heating apparatus and having an outlet at the front wall of said heating apparatus; said second network air-circulating ducts being all in substantially horizontal position and spaced apart from each other, said second network of ducts each further having a front inlet end and a rear outlet end, an upright manifold flush with the bricks lining the side walls of the heating apparatus in communication at their lower end with the first-named manifold and in communication with the inlet ends of said second network ducts, said outlet ends of said second network of ducts being disposed at the back of said heating apparatus, further including a collection chamber mounted at the back of said heating apparatus and communicating with the outlet ends of said second network of ducts, further including a first electric fan connected to the inlet of said first manifold for supplying cool air to said first manifold and a second air-circulating fan connected across said chamber, said chamber having an L-shape cross-sectional shape, said additional fan having an inlet connected with one leg of said L-shape chamber and an outlet connected with the other leg of said L-shape member; a distribution duct being also connected to said other leg of said distribution chamber, said distribution duct being adapted to distribute hot air to other rooms of a building to be heated by said heating apparatus.

* * * * *